US005800319A

United States Patent [19]

Choate

[11] Patent Number: 5,800,319

[45] Date of Patent: Sep. 1, 1998

[54] SPARRING DEVICE

[76] Inventor: Brian W. Choate, 6159 W. Dakin St., Chicago, Ill. 60634

[21] Appl. No.: 962,984

[22] Filed: Oct. 27, 1997

Related U.S. Application Data

[63] Continuation of Ser. No. 531,596, Sep. 21, 1995, abandoned.

[51] Int. Cl.[6] ..... A63B 64/20

[52] U.S. Cl. ..... 482/83; 428/87

[58] Field of Search ..... 294/31.2, 152, 294/150; 224/185; 273/55 R, 55 A; 482/83–90, 124

[56] References Cited

U.S. PATENT DOCUMENTS

| | | | |
|---|---|---|---|
| 2,586,283 | 2/1952 | Wynn | 273/55 A |
| 3,050,326 | 8/1962 | Miller | 294/31.2 |
| 3,773,287 | 11/1973 | Hechinger | 284/31.2 |
| 4,656,566 | 4/1987 | Kelley | 291/31.2 |
| 5,336,151 | 8/1994 | Van Ballegooie | 482/124 |
| 5,476,435 | 12/1995 | Nimmo | 482/124 |

*Primary Examiner*—Jerome Donnelly
*Attorney, Agent, or Firm*—Lee, Mann, Smith, McWilliams, Sweeney & Ohlson

[57] ABSTRACT

A sparring device comprising a columnar member and a sparring member is disclosed. The sparring member includes a belt portion which is fastened upon the columnar member. The sparing member also includes at least one arm portion which is normally disposed in a horizontal direction with its inner end joined to the belt portion and its outer end in at least one arcuate path the radius of which extends from the inner end of the arm portion. The sparring member may also be separable from the columnar member by unfastening the belt portion.

15 Claims, 3 Drawing Sheets

SPARRING DEVICE

This application is a continuation, of application Ser. No. 08/531,596, filed Sep. 21, 1995 now abandoned.

This invention relates to sparring devices for practicing martial arts, including boxing, karate and other similar sports which require coping with an opponent's retaliatory physical responses. More particularly, it relates to an upright dummy which may stand on its own or be suspended from an overhanging ceiling or fixture and also has a belt attached to it supporting one or more horizontally disposed, forwardly extending, flexible arms which strike back at a user whenever he hits the dummy.

BACKGROUND OF THE INVENTION

A variety of sparring devices has been available heretofore. For example, U.S. Pat. No. 4,593,900, issued Jun. 10, 1986, discloses a robot with a hollow cylindrical body. A rod running up through its middle extends out of the top of the body. The upright rod is rotated 360 degrees on the rod's upright longitudinal central axis. A stub extending horizontally outwardly from the upright rod at a point above the body holds a coil spring arm in a horizontal plane as the arm travels in its 360 degree path. The rotation of the coil spring arm is timed to cooperate with a second arm which extends out of the front of the robot and is arranged to move in a vertical plane. As noted by the opening lines of the patent, the robot's arms are situated to ward off blows directed at the robot's head.

Another example appears in U.S. Pat. No. 4,434,980, issued Mar. 6, 1984. A spherical punching bag is disclosed which is suspended between an upper coupling attached by a strap to a rigid support above the bag and a lower coupling attached by a strap to a rigid lower support below the bag. The upper coupling has a horizontal crosspiece with loop-shaped ends. Padded arms are hung on each side of the punching bag from the crosspiece. The upper ends of the arms have looped ends, each of which is linked into a looped end of the crosspiece. Internally, each of the arms has a centrally disposed elongated structural member which appears to be a slightly bent rod simulating a bent human arm. The structural member is surrounded by padding which, in turn, is surrounded by a nonabrasive cover material. In operation, when the punching bag is hit, the coupling above the bag is drawn backward sharply, causing the padded arms to swing upwardly toward the person who is using the device.

Other sparring devices are illustrated in U.S. Pat. No. 3,250,533, issued May 10, 1966, and U.S. Pat. No. 2,909,370, issued Oct. 20, 1959.

In the former, the '533 patent, a short vertical sleeve is mounted in a motorized base which is driven in an oscillating rotary motion. The lower end of a rod-like vertical spring is screwed into the sleeve, and the upper end holds the upper body of a figure of a boxer in an upright position. The boxer's arms are free to move in various direction, and such freedom of movement is accomplished by incorporating short coil springs inside the figure's elbows, hooking the ends of the springs onto bars which are disposed a short distance away from the elbow joints. The motor in the base produces a shoulder oscillation of the boxer as well as a bobbing and weaving motion of the boxer's torso due to the flexing of the vertical spring.

In the latter, the '370 patent, a simulated human figure is disclosed having a skeleton made from pipes or bars. The figure stands on a turntable. In the skeleton, a horizontally disposed bar at approximately shoulder height is connected to bars which are bent at approximately the point of shoulder joints and again at elbow joints for the human figure. The horizontal bar in the shoulders of the skeleton is held in horizontal tubular sleeves so that the bar may rotate parallel to the ground and allow the arms of the figure to raise or lower as if the figure were a boxer. The motion of the arms is occasioned by striking the head of the figure, making it turn, and permitting the horizontal bar adjacent the rods and spring member supporting the head to rotate and lift the arms.

Attaching adjunctive equipment to a punching bag by means of a belt is disclosed generally in U.S. Pat. No. 5,183,450, issued Feb. 2, 1993. A simulated leg, formed by filling a fabric sock with sand, is held in fabric straps which are sewn to the outside of the sock. The straps extend above the top of the sock and are each terminated with a flat loop. The looped end straps are attached by a user to the straps around the bag in order to fasten the simulated leg to the bag. It is then ready for the user to practice low kicks at it as if it were a human leg.

In U.S. Des. Pat. No. 169,243 a heavy punching bag is disclosed which has four stubby arms extending outwardly from the body of the bag in N S E W directions. The arms are part of the bag, covered with the same material as the body of the bag and the entire volume of the bag and arms stuffed as a unit.

In contrast to the foregoing, it is one of the objects of this invention to provide a sparring device having a generally columnar shaped body and at least one coil-spring biased arm extending outwardly from the body and flexibly connected to a belt which is simply and easily strapped onto the body.

It is further object of this invention to provide a sparring attachment for a columnar punching bag, which includes a flexible belt strapped onto the bag and a coil-spring biased arm flexibly connected at its inner end to the belt and extending outwardly from there in a normally horizontal position.

It is a further object of this invention to provide a heavy punching bag with active arm elements which stand out from the bag and then move in a myriad of directions within conically oriented paths stemming from the inner ends of the arm elements in response to blows delivered to the bag.

It is further object of this invention to provide an attachment for a columnar punching bag which inexpensively broadens and changes the variety of uses which can be made of the bag.

SUMMARY OF THE INVENTION

The present invention is a sparring dummy with at least one forwardly extending horizontal arm which is flexible itself either throughout its length or has at least a flexible segment. The arm may also be attached to the body of the dummy on a tiltable connector. Accordingly, this invention comprises a columnar member, which has a longitudinal central axis normally disposed in a vertical direction, and a sparring member. The sparring member has a belt portion fastened upon the columnar member and at least one arm portion disposed in a horizontal direction from the columnar member. The inner end of the arm is joined to the belt, and the arm's outer end is disposed in at least one accurate path which has a radius extending from the inner end of the arm.

The belt portion may be unstrapped from the columnar member whenever a user desires to work out with just the columnar member, or whenever the user wants to move the sparring member to another bag.

Other aspects and advantages of this invention will be apparent from an examination of the accompanying drawings and following detailed description.

DETAILED DESCRIPTION OF THE PREFERRED EMBODIMENTS

Figure 2:
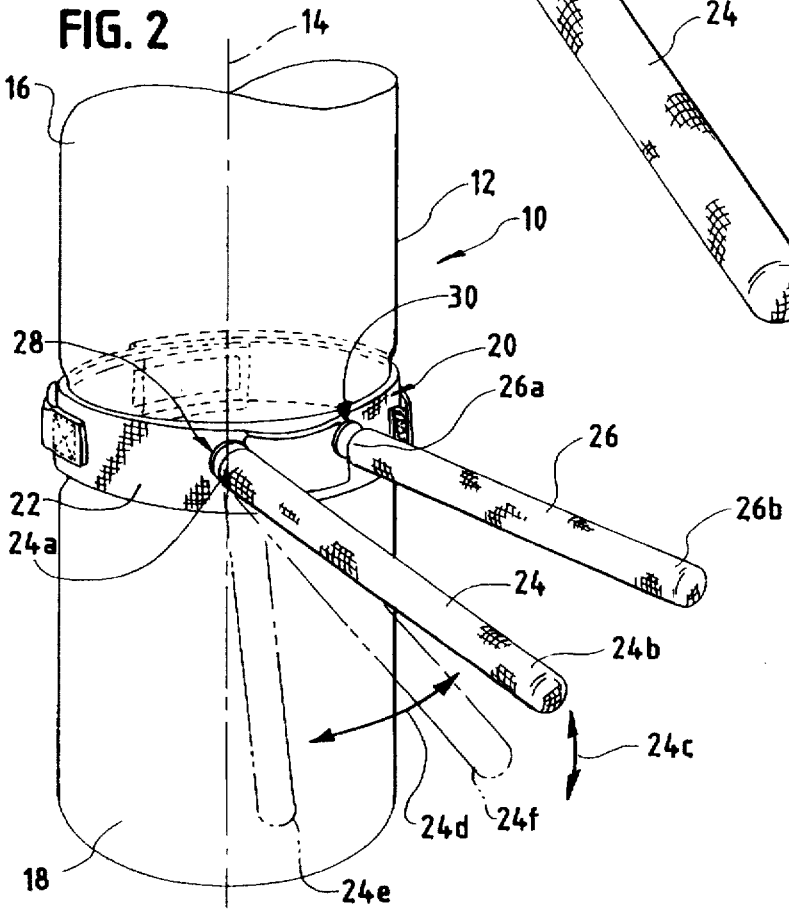
FIG. 2 is a perspective view of a columnar shaped punching bag to which the sparring attachment in FIG. 1 has been strapped.

The sparring device 10, as shown in FIG. 2, includes a columnar member 12 having a longitudinal central axis indicated at dotted line 14 which is normally disposed in a vertical direction. The columnar member has an upper end, indicated generally at 16, and a lower end, indicated generally at 18. Columnar member 12 is normally a heavy punching bag suspended from an overhead support (not shown) such as a ceiling beam, a rafter, a rack, a chain, or a cable. However, the columnar member 12 might be weighted at the bottom and thus stand alone without an upper end support. Other means besides weights in the lower end, such as a volume of sand, might be chosen to keep the columnar member 12 substantially erect and substantially in the same place on the floor of an exercise room or area.

The suspension from the ceiling or weighted disposition on the floor should be secure enough to absorb blows from a user's fists, or from kicks or open-handed chops if the user is practicing a sport like karate.

Figure 1:
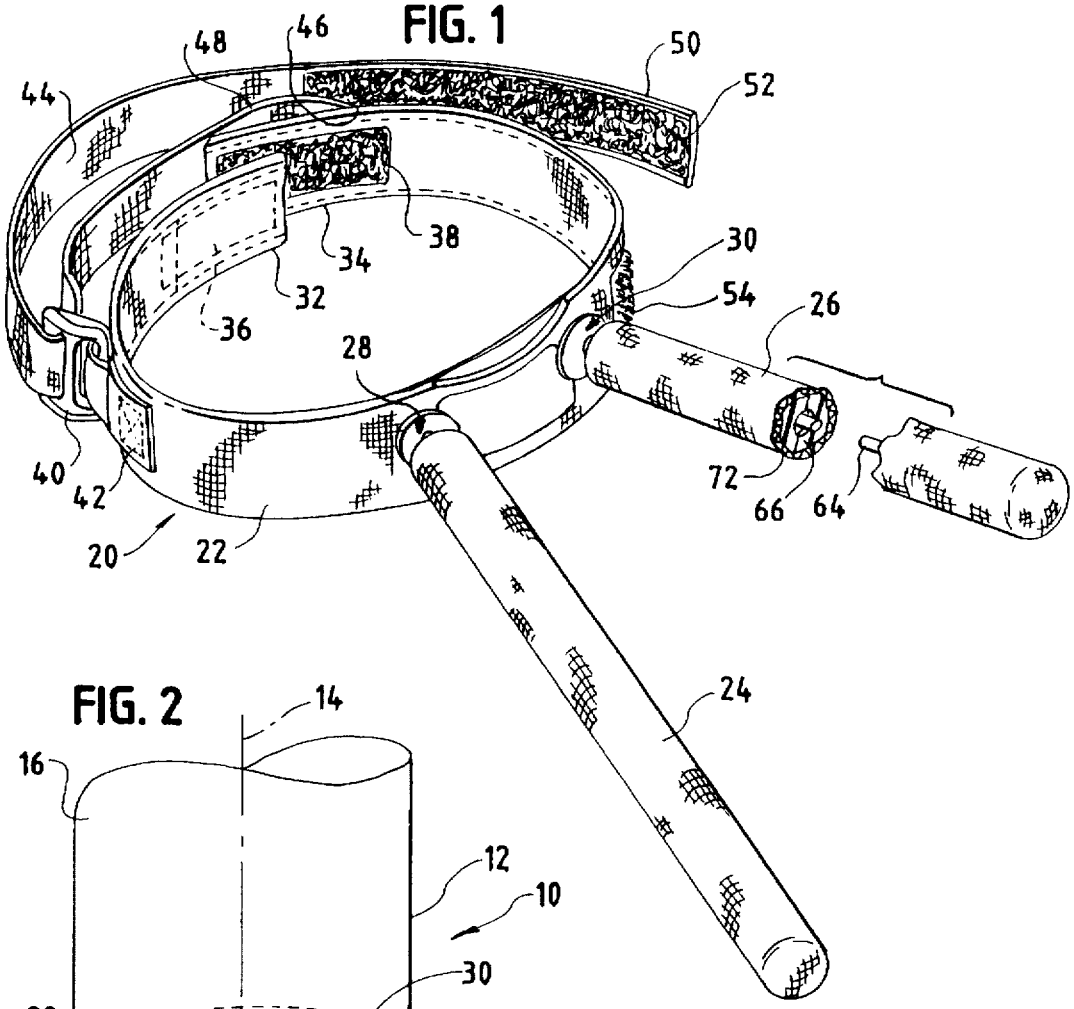
FIG. 1 is a perspective view, partially broken away, of a sparring member attachment disposable upon the upright body of a punching bag illustrating a strap assembly fastenable about the body of a bag and arms affixed to and extending outwardly from the straps.

The sparring device 10 also includes a sparring member 20, shown as being attached to bag 12 in FIG. 2 and unattached in FIG. 1. A belt portion 22 of the sparring member 20, as shown in FIG. 2, is strapped around the middle of bag 12 between the bag's upper end 16 and its lower end 18. Arms 24 and 26 are joined to the belt and extend outwardly therefrom in a horizontal plane where they are normally disposed when the bag 12 is not being used or struck. When the bag 12 is being used, however, or the arms are bumped or hit, each of the arms pivots about its inner end **24*a* and 26*a*, respectively, so that the outer ends 24*b* and 26*b*, respectively, move in accurate paths. Such a path is indicated, for example, by arrow 24*d* for arm 24**.

Referring further to arm 24 as an example, when the bag is struck or the arm is hit, the arm may move in the direction of arrow **24*d* about as far as the dotted line position shown at 24*e* before returning to the solid line position shown in FIG. 2. As is evident, the outer end 24*b* of arm 24 is disposed in an accurate path between its solid line position and its dotted line position 24*e* in FIG. 2, and the radius of the arcuate path is measured from the inner end of arm 24 which is joined to belt 22. If the bag 12 is struck from a different direction than the blow which caused arm 24 to move to position 24*e*, or arm 24 is bumped or hit differently, that arm may move in the direction indicated by arrow 24*c* as far as the dotted line position 24*f* which is shown in FIG. 2** before returning to its original solid line position.

The dotted line positions of arm 24 shown at **24*e* and 24*f* are, of course, illustrative, and that arm may move in the pivotal manner just described in a wide variety of directions and to a wide variety of positions. For the same reasons, arm 26 may move to a wide variety of positions in the same structural way, although the arms 24 and 26** are independently connected to the belt and do not necessarily move in parallel paths or at the same time.

Figure 3:
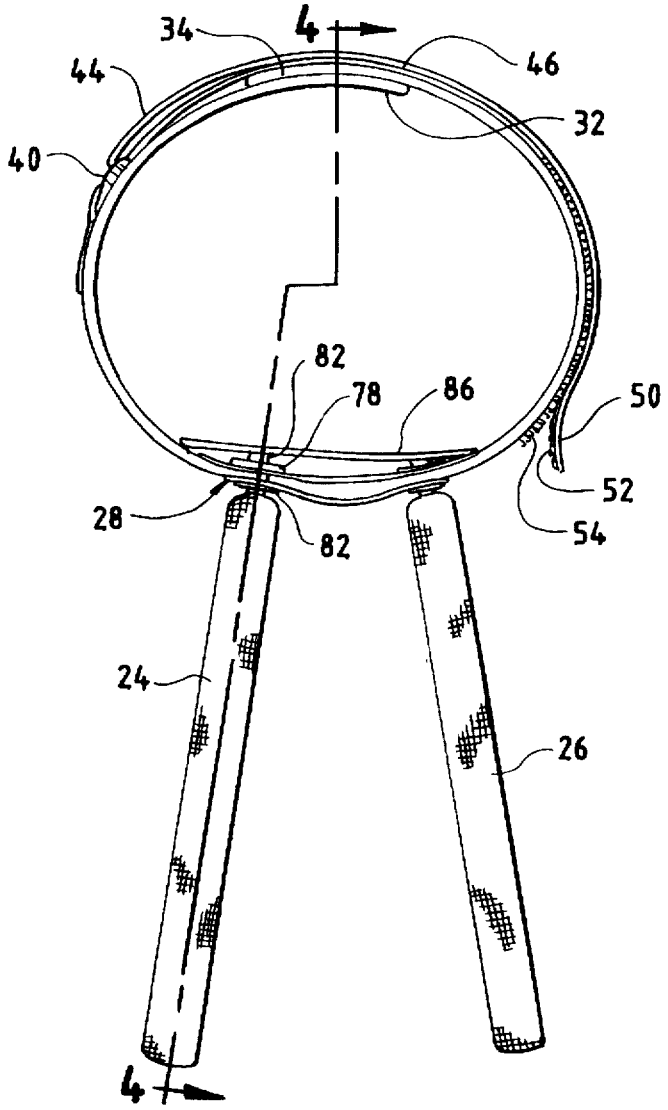
FIG. 3 is a top plan view of the sparring attachment shown in FIG. 1.
Figure 4:
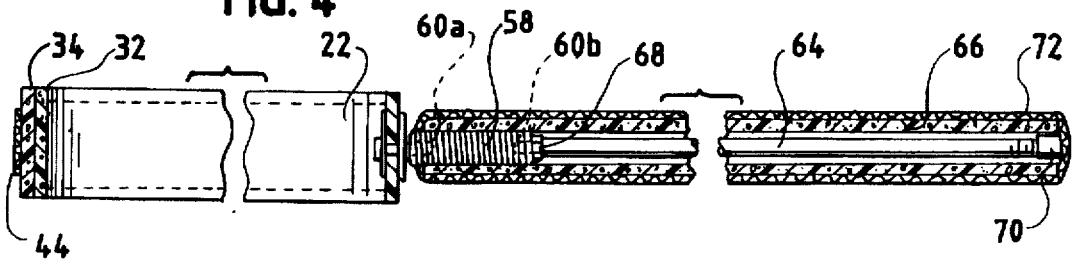
FIG. 4 is a sectional view of the attachment shown in FIG. 3 taken along the line 4—4 in FIG. 3.

Sparring member 20 is shown by itself in FIGS. 1, 3 and 4. The belt portion 22, which is to be wrapped around a columnar shaped member such as punching bag 12, is preferably made of a flexible fabric. The fabric is not only wrapped around bag 12 easily, but also permits the portions of the belt adjacent connectors 28 and 30, which join arms 24 and 26, respectively, to the belt, to flex when the connectors are forced in one direction or another as the arms move, thus contributing to the suppleness of movement of the arms during use while holding them normally in a horizontal position.

At a first end portion 32 of belt 22 there is a first fastening means 36, which may be a piece of the popular hook and loop fastening fabric which carries the trademark VELCRO, arranged at the second end portion 34 of the belt to engage a second fastening means 38 also made of VELCRO material. Further, reinforcement may be provided by secondary fastening means on the belt to draw the first and second belt end portions 32 and 34 more closely together and support them when they are engaged. Such secondary fastening means may be provided by a buckle 40 attached to the outside of the belt 22 with a shankpiece 42, the latter being located a short distance back along the belt 22 from the first end portion 32. A strap 44 has a base end 48 fastened to the outside of belt 22 at base fastening point 46 adjacent end portion 34 of belt 22. The strap 44 is long enough to overlie the first and second belt end portions 32 and 34, be threaded through buckle 40 adjacent end portion 32, and be brought back again over the first and second belt end portions 32 and 34 to approximately the outside of the belt just beyond the second end portion 34 and base fastening point 46. The strap 44 has a free end 50 with a portion of VELCRO fabric 52 on the inside of the strap, near the end 50. A second length of VELCRO fabric 54 is disposed on the outside belt 22, well back of end portion 34. The VELCRO fabric portion 52 may be engaged on VELCRO fabric portion 54 when the strap 44 is pulled through buckle 40 and is held tightly against the joined belt end portions 32 and 34.

FIG. 1 shows the belt portion 22 in a relaxed state with its end portions 32 and 34 unfastened and the strap 44 loosely threaded through buckle 40. Free end 50 is spaced apart from the rest of belt portion 22, and VELCRO portions 52 and 54 are unfastened. FIG. 3, in contrast, shows the belt portion 22 in its fastened-together state: the first and second end portions 32 and 34 are engaged in an overlapping connection which adjusts the girth of the belt portion 22 snugly around the outside of a heavy punching bag such as the columnar member 12 (as in FIG. 2), and strap 44 is pulled tight through buckle 40, around the outside of belt portion 22, over the overlapping connection of end portions 32 and 34, and from there over the strap's base fastening point 46, and beyond, along the belt to the point where the free end 50 is fastened along the outside of the belt portion 22 by VELCRO fabric fasteners 52 and 54.

Figure 5:
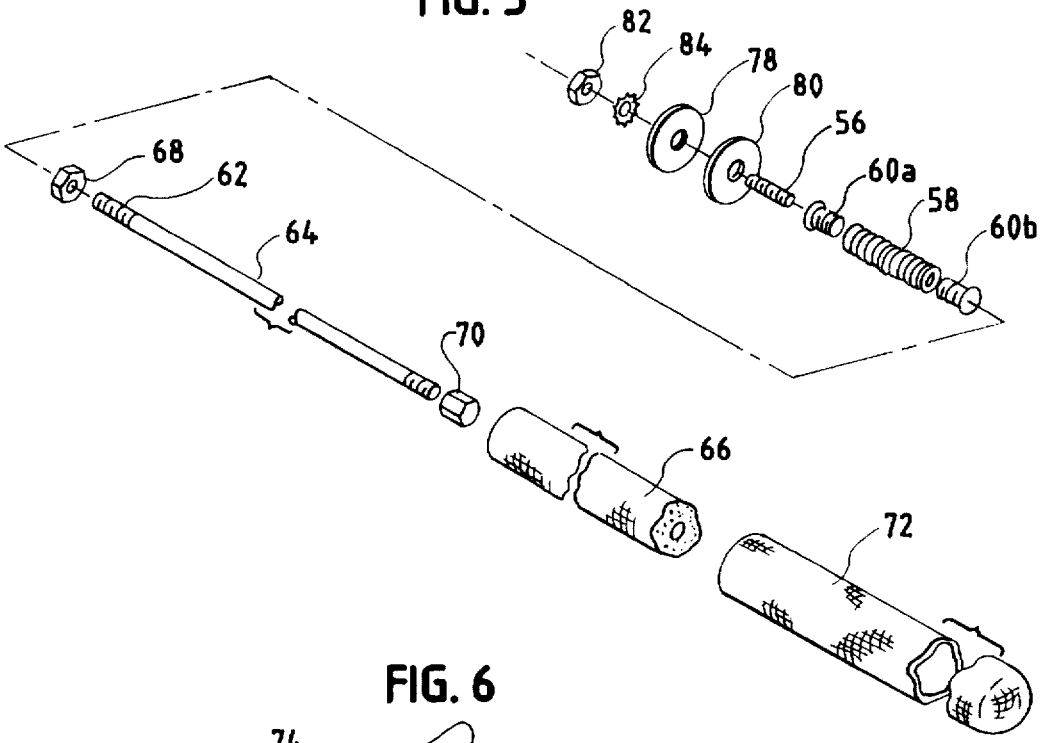
FIG. 5 is an exploded view, partly broken away, of the parts of the arm shown in FIG. 4.

The arms 24 and 26 are joined at their inner ends 24*a* and 26*a* to the belt portion 22 by a hinge means which, referring to arm 24 as illustrative, includes a threaded pin 56 (see FIG. 5), a coil spring 58, a pair of internally and externally threaded connector caps 60*a* and 60*b*, and an externally threaded inner end 62 of a rod 64. The rod 64, preferably a straight length of lightweight metal, functions as a skeletal member inside arm 24. Surrounding the rod is a centrally apertured tube 66 of foamed plastic which forms the body of the arm. When the arm 24 is assembled, one end of pin 56 is screwed into connector cap 60*a* which in turn is mounted in the inner end of coil spring 58. Connector cap 60*b* is also fixed inside the outer end of coil spring 58. A locking nut 68 is screwed onto the inner end 62 of rod 64 and then the inner end 62 is screwed into connector cap 60*b*, where locking nut 68 is engaged against it. A tip-covering cap 70 is fastened to the outer end of rod 64, and then the foam tube 66, which forms the outer body of the arm, is telescopically slid over the length of the skeletal member, outer end first. The entire arm is covered by tube 66 including the innermost connector cap 60*a*.

It is often desirable to clothe the arm assembly, and accordingly cover 72, which may be a fabric sleeve, is drawn over the entire foam tube. Normally the tension of the fabric on the outer surface of the foam tube will be sufficient to hold the cover in place, although it may be tied adjacent the end of the arm closest to the belt portion 22(not shown) or held in place there by a knit cuff (not shown).

Figure 6:
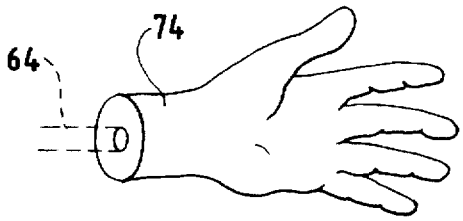
FIG. 6 is a perspective view of an accessory hand which may be assembled with the parts of the arm shown in FIG. 5.
Figure 7:
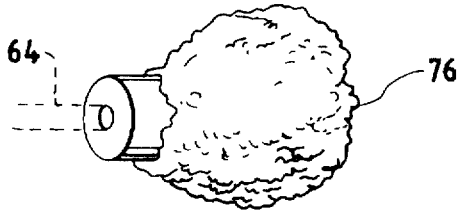
FIG. 7 is a perspective view of an accessory chalk marker which may be assembled with the parts of the arm shown in FIG. 5.

A person using the bag 12 with the sparring member attached might prefer even more realism in the arms, or he might prefer to know more exactly where the tips of the arms strike back at him. Accordingly, the cover 72, the foam tube 66, and the tip-covering cap 70 may not be used, and instead, a soft plastic hand 74 may be joined to the outer end of the rod 64 (See FIG. 6). Alternatively, a powder marker 76 may be used as an accessory instead of the hand 74 (See FIG. 7). If a user prefers a hand on one or both arms, he can imagine an opponent's hands slapping him as he punches or kicks the bag and causes the arms to move. In case he prefers the powder marker, he will find the spots on his body after his workout where the retaliating blows of the arm(s) carrying a marker struck him.

Connectors 28 and 30 are constructed in such a manner as to seize and clamp onto the fabric of the belt portion 22 of sparring member 20 and provide a supple movement to the arms 24 and 26 when the bag 12 is moved or struck. The suppleness is due particularly to the flexibility of the fabric from which the belt is made and also the flexibility of the coil springs such as 58 in each of the arms. Notwithstanding such suppleness of movement, whenever the arms are at rest they are held in a substantially horizontal attitude.

Referring to connector 28 as an example, two large, flat washers 78 and 80 are utilized, washer 78 on the inside of belt portion 22 and washer 80 on the outside of the belt portion 22. A hole (not shown) is provided through the fabric of the belt, registered with the central apertures in the washers 78 and 80, and the threaded pin 56 is inserted therein. On the inside of the belt portion 22, a nut and lock washer, 82 and 84 respectively, are engaged on pin 56 against washer 78, while on the outside of the belt portion 22 connector cap 60*a* is drawn up against washer 80. The washers are thus clamped onto the belt, and coil spring 58 is firmly connected to the washers through pin 56 by cap 60*a* to which coil spring 58 is attached. The combination of the washer assembly and the coil spring thus forms a hinge means for the arm 24 at its inner end 24*a*.

When the form of connector to the belt portion which has just been described is utilized, it is apparent that the nuts such as 82 on the inside of the belt portion will move around abrasively on the outer surface of bag 12 when the belt portion 22 is flexed during use of the device. Accordingly, in order to protect the bag's outer surface, it is desirable to provide a cover 86 of tough material over the nuts and washers or similar fastening means and avoid the wear and tear which they would produce on the bag.

Figure 8:
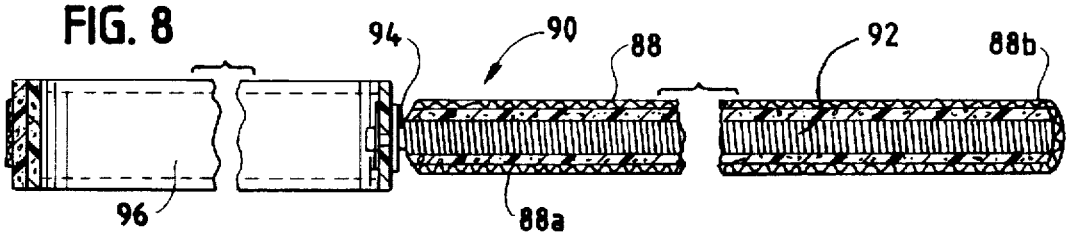
FIG. 8 is a sectional view of an alternative form of the attachment shown in FIG. 4.

An alternative form of sparring member arm construction is illustrated in FIG. 8. In that figure, arm portion 88 of the sparring member 90 is constructed substantially the same way as arm portion 24 except that instead of having a rod 64 as a skeletal member extending from coil spring 58, arm portion 88 incorporates an elongated coil spring 92 as a skeletal member and coil spring combined inside the arm. Coil spring 92 is almost as long as arm portion 88 itself, extending all the way from connector cap 94 at the inner end 88*a* of arm portion 88 to the outer end 88*b* of that arm portion. The other elements of arm portion 88 in FIG. 8 are identical to those of arm portion 24 in sparring member 20 in FIG. 1. The belt portion 96 of sparring member 90 is also identical to belt portion 22 of sparring member 20 in FIG. 1.

To create a sparring device embodying the inventive elements and combinations described herein, a user may arrange the belt portion 22 of sparring member 20 around a columnar member 12 and fasten it so that arms 24 and 26 extend outwardly from the columnar member at a convenient height. In fastening the belt, its end portions 32 and 34 are overlapped enough so that the belt will squeeze the columnar member somewhat at a selected height. Then the VELCRO patches 36 and 38 are pressed together to fasten them to each other. Reinforcement of the fastening is provided by pulling strap 44 through buckle 40 and wrapping it over ends 32 and 34 so as to press them snugly together. Fastening the belt portion 22 around the columnar member 12 in this manner connects the sparring member and the columnar member securely together and forms a unitary sparring device.

When a user strikes the bag or the arms, either with his fists or with his feet, or with any other type of contact, the arms will gyrate about their hinged connections to the belt portion 22. Both the response of the coil spring in the hinged connection and the flexibility of the fabric web in the belt contribute to the suppleness of movement of the arms 24 and 26. Each arm is capable of gyrating in a conical space having its vertex at a connector, which is the connector 28 for example for arm 24. The extent of the arms' gyrations may be diminished by fastening the belt portion 22 very tightly around the bag, so that the fabric will not flex very much or separate from the outside of the bag. The gyrations may also be enhanced by fastening the belt portion 22 somewhat loosely around the bag, giving the fabric and connectors more freedom of movement.

Whenever a user wants to practice with the sparring member 20 on a different weight or form of bag, it is only necessary to loosen strap 44 and release the ends 32 and 34 of belt portion 22. This will let the sparring member slide down and off the lower end of the bag 12, and it can be assembled on another bag. Easy portability of the sparring member is advantageous also to a user who may not have a bag of his own but wants to practice with the sparring member on a bag at a local gym or work-out center.

The embodiments of this invention which are described above may be embraced in other specific forms without departing from the spirit or essential characteristics of the invention. The described embodiments are, therefore, to be considered in all respects as illustrative and not restrictive, the scope of the invention being indicated by the claims rather than by the foregoing description. Accordingly, all changes which come within the meaning and range of the equivalents of the claims are intended to be covered therein.

I claim:

1. A sparring device comprising a columnar member having a longitudinal central axis normally disposed in a vertical direction, and a sparring member including a belt portion having arm connector means thereon fastened upon the columnar member, and at least one arm portion normally disposed in a horizontal attitude from the columnar member and moveable in a gyrating manner in a substantially conical space, said arm portion having an inner end joined to the arm connector means on the belt portion and an outer end disposed in a plurality of arcuate paths across the broad end of the conical space and having a radius extending from the inner end of the arm portion.

2. The sparring device of claim 1 in which the belt portion is a flexible web having first and second end portions, each of said end portions having fastening means thereon for engaging said first and second end portions together.

3. The sparring device of claim 2 in which a buckle is attached to the first end portion of the belt portion and a strap is attached to the second end portion of the belt portion, said strap being engagable in said buckle for drawing the belt end portions together, and fastening means attached to an end portion of the strap and an outside face of the belt portion for engaging said strap end portion and outside face together.

4. A sparring device comprising a columnar member having a longitudinal central axis normally disposed in a vertical direction, and a sparring member including a belt portion having arm connector means thereon fastened upon the columnar member, at least one arm portion normally disposed in a horizontal attitude from the columnar member and moveable in a gyrating manner in a substantially conical space, said arm portion having an inner end joined to the arm connector means on the belt portion and an outer end disposed in a plurality of arcuate paths across the broad end of the conical space and having a radius extending from the inner end of the arm portion, and hinge means affixing the arm portion to the arm connector means on the belt portion and holding the arm portion outwardly from the columnar member.

5. The sparring device of claim 4 in which the arm portion includes an internal skeletal member joined to the hinge means, and a body member telescopically engaged upon the skeletal member and forming a pad surrounding the skeletal member.

6. The sparring device of claim 5 in which a protective sleeve covers the body member, said sleeve being elastically held on the body member by tension embodied in the fabric of the sleeve.

7. The sparring device of claim 5 in which the skeletal member is a straight rod, and the body member is a stiff foam cylinder having a longitudinal cavity therein surrounding the rod.

8. The sparring device of claim 5 in which the internal skeletal member is an elongated coil spring.

9. The sparring device of claim 7 in which the hinge means includes a coil spring portion having a first internally threaded end, the skeletal member includes a first externally threaded end engaged in the first internally threaded end of the coil spring portion, and the body member telescopically covers substantially the entire length of the skeletal member and the coil spring portion of the hinge means.

10. The sparring device of claim 4 in which the arm portion includes a rod having an inner first end joined to the hinge means, and an outer second end joined to a sparring accessory element.

11. The sparring device of claim 10 in which the sparring accessory element is a replica of a hand.

12. The sparring device of claim 10 in which the sparring accessory element is a chalk marker.

13. A sparring member for attachment to a columnar member having an upper end and lower end comprising a belt portion for attaching the sparring member to the columnar member intermediate the upper and lower ends and having arm connector means thereon, and at least one arm portion normally disposed in a horizontal attitude from the columnar member and moveable in a gyrating manner in a substantially conical space when the sparring member is attached to the columnar member, said arm portion having an inner end joined to the arm connector means on the belt portion and an outer end disposed in a plurality of arcuate paths across the broad end of the conical space and having a radius extending from the inner end of the arm portion.

14. The sparring member of claim 13 in which a pair of arm portions are joined to the belt portion and diverge outwardly from each other from the belt portion.

15. A sparring device comprising a columnar member having a longitudinal central axis normally disposed in a vertical direction, and a sparring member including a belt portion having arm connector means thereon fastened upon the columnar member, at least one arm portion normally disposed in a horizontal attitude from the columnar member and moveable in a gyrating manner in a substantially conical space, said arm portion having an inner end joined to the arm connector means on the belt portion and an outer end disposed in a plurality of arcuate paths across the broad end of the conical space and having a radius extending from the inner end of the arm portion, and hinge means including a coil spring at the inner end of the arm portion for flexibly affixing the arm portion to the arm connector means on the belt portion and holding the arm portion outwardly from the columnar member.

* * * * *